US012479554B2

(12) United States Patent
Saruwatari et al.

(10) Patent No.: US 12,479,554 B2
(45) Date of Patent: Nov. 25, 2025

(54) OUTBOARD MOTOR AND MARINE VESSEL

(71) Applicant: YAMAHA HATSUDOKI KABUSHIKI KAISHA, Iwata (JP)

(72) Inventors: Kimitaka Saruwatari, Shizuoka (JP); Yuhei Suzuki, Shizuoka (JP); Akira Harabe, Shizuoka (JP); Genta Otsuki, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 681 days.

(21) Appl. No.: 17/880,847

(22) Filed: Aug. 4, 2022

(65) Prior Publication Data

US 2023/0049819 A1 Feb. 16, 2023

(30) Foreign Application Priority Data

Aug. 16, 2021 (JP) ..... 2021-132343

(51) Int. Cl.

| | |
|---|---|
| ***B63H 20/12*** | (2006.01) |
| ***B63H 20/02*** | (2006.01) |
| ***B63H 23/34*** | (2006.01) |

(52) U.S. Cl.

CPC ..... *B63H 20/12* (2013.01); *B63H 20/02* (2013.01); *B63H 23/34* (2013.01)

(58) Field of Classification Search

CPC ..... B63H 20/12; B63H 20/02; B63H 23/34

See application file for complete search history.

(56) References Cited

U.S. PATENT DOCUMENTS

2010/0167604 A1* 7/2010 Inaba ..... B63H 20/12 440/60

2014/0329422 A1* 11/2014 Ito ..... B63H 5/08 440/1

FOREIGN PATENT DOCUMENTS

JP 2013-163439 A 8/2013

* cited by examiner

*Primary Examiner* — Stephen P Avila

(74) *Attorney, Agent, or Firm* — Keating & Bennett, LLP

(57) ABSTRACT

An outboard motor includes a bracket, an outboard motor main body including an upper portion attachable to a hull via the bracket and a lower portion located below the upper portion and on which a propeller is provided, a first steering mechanism to rotate the upper portion in a right-left direction with respect to the hull, and a second steering mechanism to rotate the lower portion in the right-left direction with respect to the upper portion.

20 Claims, 6 Drawing Sheets

OUTBOARD MOTOR AND MARINE VESSEL

CROSS REFERENCE TO RELATED APPLICATIONS

This application claims the benefit of priority to Japanese Patent Application No. 2021-132343 filed on Aug. 16, 2021. The entire contents of this application are hereby incorporated herein by reference.

BACKGROUND OF THE INVENTION

1. Field of the Invention

The present invention relates to an outboard motor and a marine vessel, and more particularly, it relates to an outboard motor and a marine vessel each including a steering mechanism to rotate an outboard motor main body in a right-left direction with respect to a hull.

2. Description of the Related Art

An outboard motor including a steering mechanism to rotate an outboard motor main body in a right-left direction with respect to a hull is known in general. Such an outboard motor is disclosed in Japanese Patent Laid-Open No. 2013-163439, for example.

Japanese Patent Laid-Open No. 2013-163439 discloses an outboard motor including an outboard motor main body and a bracket. In the outboard motor described in Japanese Patent Laid-Open No. 2013-163439, the outboard motor main body is attached to a hull via the bracket so as to be rotatable in a right-left direction. Thus, the outboard motor main body including a propeller is rotated with respect to the hull in the right-left direction. That is, steering (changing the direction of the propeller with respect to the hull) is performed.

Although not described in Japanese Patent Laid-Open No. 2013-163439, in a conventional outboard motor as described in Japanese Patent Application Laid-Open No. 2013-163439, an angular range in which an outboard motor main body is rotatable in a right-left direction with respect to a hull is limited to a relatively small range to prevent the outboard motor main body from interfering with a bracket when the outboard motor main body is rotated in the right-left direction with respect to the hull. Therefore, it is desired to increase the angular range in which the outboard motor main body is rotatable in the right-left direction with respect to the hull.

SUMMARY OF THE INVENTION

Preferred embodiments of the present invention provide outboard motors and marine vessels that each increase angular ranges in which outboard motor main bodies are rotatable in a right-left direction with respect to hulls.

An outboard motor according to a preferred embodiment of the present invention includes a bracket, an outboard motor main body including an upper portion attachable to a hull via the bracket and a lower portion located below the upper portion and on which a propeller is provided, a first steering mechanism to rotate the upper portion in a right-left direction with respect to the hull, and a second steering mechanism to rotate the lower portion in the right-left direction with respect to the upper portion.

An outboard motor according to a preferred embodiment of the present invention includes the first steering mechanism to rotate the upper portion in the right-left direction with respect to the hull, and the second steering mechanism to rotate the lower portion in the right-left direction with respect to the upper portion. Accordingly, the first steering mechanism rotates the entire outboard motor main body including the upper portion attached to the hull via the bracket and the lower portion located below the upper portion in the right-left direction with respect to the hull, and the second steering mechanism rotates the lower portion, which is a portion of the outboard motor main body, in the right-left direction with respect to the upper portion, which is another portion of the outboard motor main body. Consequently, the rotation of the entire outboard motor main body in the right-left direction by the first steering mechanism and the rotation of the partial outboard motor main body in the right-left direction by the second steering mechanism are combined such that an angular range in which the outboard motor main body is rotatable in the right-left direction with respect to the hull is increased as compared with a case in which the entire outboard motor main body is only rotated in the right-left direction. The lower portion is rotated in the right-left direction with respect to the upper portion by the second steering mechanism without rotating the upper portion attached to the hull via the bracket in the right-left direction, and thus the angular range in which the outboard motor main body is rotatable in the right-left direction with respect to the hull is increased while the outboard motor main body does not interfere with the bracket.

In an outboard motor according to a preferred embodiment of the present invention, the first steering mechanism and the second steering mechanism are preferably operable independently of each other. Accordingly, the angular range in which the outboard motor main body is rotatable in the right-left direction with respect to the hull is the sum of an angular range in which the upper portion is rotatable in the right-left direction with respect to the hull by the first steering mechanism and an angular range in which the lower portion is rotatable in the right-left direction with respect to the upper portion by the second steering mechanism, and thus the angular range in which the outboard motor main body is rotatable with respect to the hull is reliably increased.

An outboard motor according to a preferred embodiment of the present invention preferably further includes an engine corresponding to a drive source to drive the propeller, the engine is preferably provided in the upper portion, the lower portion preferably has an angular range in which the lower portion is rotatable in the right-left direction with respect to the upper portion by the second steering mechanism, the upper portion preferably has an angular range in which the upper portion is rotatable in the right-left direction with respect to the hull by the first steering mechanism, and the angular range of the lower portion is preferably larger than the angular range of the upper portion. The upper portion in which the engine is provided is particularly large in size, and thus particularly when the engine is provided in the upper portion, the angular range in which the upper portion is rotatable in the right-left direction with respect to the hull by the first steering mechanism is limited to a small range such that the upper portion does not interfere with the bracket when the upper portion is rotated with respect to the hull. On the other hand, as described above, the lower portion is rotated in the right-left direction with respect to the upper portion by the second steering mechanism without rotating the upper portion attached to the hull via the bracket in the right-left direction, and thus the angular range in which the outboard motor main body is rotatable with respect to the hull is increased while the outboard motor main body does not interfere with the bracket. Therefore, the angular range in which the outboard motor main body is rotatable in the right-left direction with respect to the hull is effectively increased.

In an outboard motor according to a preferred embodiment of the present invention, the first steering mechanism preferably includes a first steering shaft and rotates the upper portion around the first steering shaft in the right-left direction with respect to the hull, and the second steering mechanism preferably includes a second steering shaft provided separately from the first steering shaft and rotates the lower portion around the second steering shaft in the right-left direction with respect to the upper portion. Accordingly, the second steering shaft is provided separately from the first steering shaft such that the degree of freedom in providing the second steering shaft with respect to the first steering shaft is improved, and as compared with a case in which the second steering shaft is not provided separately from the first steering shaft, complex structures of the first steering mechanism and the second steering mechanism are significantly reduced or prevented.

In such a case, the second steering mechanism preferably further includes a hydraulic pump to rotate the second steering shaft, and a pump drive motor to drive the hydraulic pump, the hydraulic pump and the pump drive motor are preferably provided in a lower portion of the upper portion, and the second steering shaft preferably extends across the lower portion of the upper portion and an upper portion of the lower portion. Accordingly, the second steering shaft extends across the lower portion of the upper portion and the upper portion of the lower portion such that as compared with a case in which the second steering shaft does not extend across the upper portion and the lower portion, the operation of the second steering mechanism to rotate the lower portion in the right-left direction around the second steering shaft with respect to the upper portion is stabilized. Furthermore, the hydraulic pump and the pump drive motor provided to rotate the second steering shaft are provided in the lower portion of the upper portion that is relatively close to the second steering shaft extending across the lower portion of the upper portion and the upper portion of the lower portion, and thus an increase in a space to install the second steering mechanism including the second steering shaft, the hydraulic pump, and the pump drive motor is significantly reduced or prevented.

In an outboard motor including the first steering mechanism to rotate the entire outboard motor main body around the first steering shaft in the right-left direction with respect to the hull, and the second steering mechanism to rotate the lower portion around the second steering shaft in the right-left direction with respect to the upper portion, the second steering shaft is preferably located behind the first steering shaft. Accordingly, the lower portion is less likely to be larger on the front side (hull side) as compared with a case in which the second steering shaft is located in front of the first steering shaft, and thus the angular range in which the outboard motor main body is rotatable with respect to the hull is easily increased while the outboard motor main body does not interfere with the bracket.

An outboard motor according to a preferred embodiment of the present invention preferably further includes an engine corresponding to a drive source to drive the propeller, and a drive shaft to transmit a driving force from the engine to the propeller, and the second steering shaft is preferably coaxial with the drive shaft. Accordingly, the second steering shaft is coaxial with the drive shaft such that, as compared with a case in which the second steering shaft is not coaxial with the drive shaft, an increase in a space to install the second steering shaft and the drive shaft is significantly reduced or prevented. Furthermore, the second steering shaft is coaxial with the drive shaft such that the lower portion is rotated with respect to the upper portion by the second steering mechanism without changing the horizontal position of the drive shaft, and thus, as compared with a case in which the second steering shaft is not coaxial with the drive shaft, the complexity of the structure of the second steering mechanism is significantly reduced or prevented.

An outboard motor according to a preferred embodiment of the present invention preferably further includes a shift actuator to switch a shift state of the outboard motor, the shift actuator is preferably provided in the lower portion, and the second steering mechanism preferably rotates the shift actuator together with the lower portion. Accordingly, the shift actuator is provided in the lower portion and is rotated together with the lower portion by the second steering mechanism such that the lower portion is rotated in the right-left direction with respect to the upper portion by the second steering mechanism while a complex structure of the shift actuator is significantly reduced or prevented as compared with a case in which the shift actuator is provided across the upper portion and the lower portion, for example.

An outboard motor according to a preferred embodiment of the present invention preferably further includes an engine corresponding to a drive source to drive the propeller, and a propeller shaft that rotates together with the propeller, the upper portion preferably includes a cowling in which the engine is provided, and an upper case below the cowling, the lower portion preferably includes a lower case in which the propeller shaft is provided, and the second steering mechanism preferably includes a portion fixed to a lower portion of the upper case, and another portion fixed to an upper portion of the lower case. Accordingly, a portion of the second steering mechanism is fixed to the lower portion of the upper case, and another portion of the second steering mechanism is fixed to the upper portion of the lower case such that the second steering mechanism easily rotates the lower portion in the right-left direction with respect to the upper portion.

In an outboard motor according to a preferred embodiment of the present invention, both the first steering mechanism and the second steering mechanism are preferably driven when a steering angle of the outboard motor is larger than a predetermined steering angle or when a steering speed of the outboard motor is higher than a predetermined speed, and the second steering mechanism is preferably driven when the steering angle is equal to or smaller than the predetermined steering angle or when the steering speed is equal to or lower than the predetermined speed. Accordingly, when it is necessary to largely rotate the outboard motor main body with respect to the hull, both the first steering mechanism and the second steering mechanism are driven such that the outboard motor main body is largely rotated with respect to the hull, and when it is necessary to rapidly rotate the outboard motor main body with respect to the hull, both the first steering mechanism and the second steering mechanism are driven such that the outboard motor main body is rapidly rotated with respect to the hull. When it is not necessary to largely rotate the outboard motor main body with respect to the hull, and when it is not necessary to rapidly rotate the outboard motor main body with respect to the hull, the second steering mechanism is driven without driving the first steering mechanism such that a portion of the outboard motor main body is rotated with respect to another portion of the outboard motor main body without rotating the entire outboard motor main body with respect to the hull. Consequently, an increase in the driving energy to rotate the outboard motor main body in the right-left direction with respect to the hull is significantly reduced or prevented when it is not necessary to largely rotate the outboard motor main body with respect to the hull, and when it is not necessary to rapidly rotate the outboard motor main body with respect to the hull.

A marine vessel according to a preferred embodiment of the present invention includes a hull and an outboard motor attached to the hull, and the outboard motor includes a bracket, an outboard motor main body including an upper portion attached to the hull via the bracket and a lower portion located below the upper portion and on which a propeller is provided, a first steering mechanism to rotate the upper portion in a right-left direction with respect to the hull, and a second steering mechanism to rotate the lower portion in the right-left direction with respect to the upper portion.

A marine vessel according to a preferred embodiment of the present invention includes the first steering mechanism to rotate the upper portion in a right-left direction with respect to the hull, and the second steering mechanism to rotate the lower portion in the right-left direction with respect to the upper portion. Accordingly, an angular range in which the outboard motor main body is rotatable in the right-left direction with respect to the hull is increased, similarly to the outboard motors according to preferred embodiments of the present invention described above.

In a marine vessel according to a preferred embodiment of the present invention, the first steering mechanism and the second steering mechanism are preferably operable independently of each other. Accordingly, the angular range in which the outboard motor main body is rotatable with respect to the hull is reliably increased, similarly to the outboard motors according to preferred embodiments of the present invention described above.

In a marine vessel according to a preferred embodiment of the present invention, the outboard motor preferably further includes an engine corresponding to a drive source to drive the propeller, the engine is preferably provided in the upper portion, the lower portion preferably has an angular range in which the lower portion is rotatable in the right-left direction with respect to the upper portion by the second steering mechanism, the upper portion preferably has an angular range in which the upper portion is rotatable in the right-left direction with respect to the hull by the first steering mechanism, and the angular range of the lower portion is preferably larger than the angular range of the upper portion. Accordingly, the angular range in which the outboard motor main body is rotatable in the right-left direction with respect to the hull is effectively increased, similarly to the outboard motors according to preferred embodiments of the present invention described above.

In a marine vessel according to a preferred embodiment of the present invention, the first steering mechanism preferably includes a first steering shaft and rotates the upper portion around the first steering shaft in the right-left direction with respect to the hull, and the second steering mechanism preferably includes a second steering shaft provided separately from the first steering shaft and rotates the lower portion around the second steering shaft in the right-left direction with respect to the upper portion. Accordingly, similarly to the outboard motors according to preferred embodiments of the present invention described above, the degree of freedom in providing the second steering shaft with respect to the first steering shaft is improved, and as compared with a case in which the second steering shaft is not provided separately from the first steering shaft, complex structures of the first steering mechanism and the second steering mechanism are significantly reduced or prevented.

In such a case, the second steering mechanism preferably further includes a hydraulic pump to rotate the second steering shaft, and a pump drive motor to drive the hydraulic pump, the hydraulic pump and the pump drive motor are preferably provided in a lower portion of the upper portion, and the second steering shaft preferably extends across the lower portion of the upper portion and an upper portion of the lower portion. Accordingly, as compared with a case in which the second steering shaft does not extend across the upper portion and the lower portion, the operation of the second steering mechanism to rotate the lower portion in the right-left direction around the second steering shaft with respect to the upper portion is stabilized, similarly to the outboard motors according to preferred embodiments of the present invention described above. Furthermore, an increase in a space to install the second steering mechanism is significantly reduced or prevented, similarly to the outboard motors according to preferred embodiments of the present invention described above.

In a marine vessel including the first steering mechanism to rotate the entire outboard motor main body around the first steering shaft in the right-left direction with respect to the hull, and the second steering mechanism to rotate the lower portion around the second steering shaft in the right-left direction with respect to the upper portion, the second steering shaft is preferably located behind the first steering shaft. Accordingly, the angular range in which the outboard motor main body is rotatable with respect to the hull is easily increased while the outboard motor main body does not interfere with the bracket, similarly to the outboard motors according to preferred embodiments of the present invention described above.

In a marine vessel according to a preferred embodiment of the present invention, the outboard motor preferably further includes an engine corresponding to a drive source to drive the propeller, and a drive shaft to transmit a driving force from the engine to the propeller, and the second steering shaft is preferably coaxial with the drive shaft. Accordingly, an increase in a space to install the second steering shaft and the drive shaft is significantly reduced or prevented, similarly to the outboard motors according to preferred embodiments of the present invention described above. Furthermore, a complex structure of the second steering mechanism is significantly reduced or prevented, similarly to the outboard motors according to preferred embodiments of the present invention described above.

In a marine vessel according to a preferred embodiment of the present invention, the outboard motor preferably further includes a shift actuator to switch a shift state of the outboard motor, the shift actuator is preferably provided in the lower portion, and the second steering mechanism preferably rotates the shift actuator together with the lower portion. Accordingly, the lower portion is rotated in the right-left direction with respect to the upper portion by the second steering mechanism while a complex structure of the shift actuator is significantly reduced or prevented, similarly to the outboard motors according to preferred embodiments of the present invention described above.

In a marine vessel according to a preferred embodiment of the present invention, the outboard motor preferably further includes an engine corresponding to a drive source to drive the propeller, and a propeller shaft that rotates together with the propeller, the upper portion preferably includes a cowling in which the engine is provided, and an upper case below the cowling, the lower portion preferably includes a lower case in which the propeller shaft is provided, and the second steering mechanism preferably includes a portion fixed to a lower portion of the upper case, and another portion fixed to an upper portion of the lower case. Accordingly, the second steering mechanism easily rotates the lower portion in the right-left direction with respect to the upper portion, similarly to the outboard motors according to preferred embodiments of the present invention described above.

In a marine vessel according to a preferred embodiment of the present invention, both the first steering mechanism and the second steering mechanism are preferably driven when a steering angle of the outboard motor is larger than a predetermined steering angle or when a steering speed of the outboard motor is higher than a predetermined speed, and the second steering mechanism is preferably driven when the steering angle is equal to or smaller than the predetermined steering angle or when the steering speed is equal to or lower than the predetermined speed. Accordingly, similarly to the outboard motors according to preferred embodiments of the present invention described above, when it is necessary to largely rotate the outboard motor main body with respect to the hull, the outboard motor main body is largely rotated with respect to the hull, and when it is necessary to rapidly rotate the outboard motor main body with respect to the hull, the outboard motor main body is rapidly rotated with respect to the hull. Furthermore, similarly to the outboard motors according to preferred embodiments of the present invention described above, when it is not necessary to largely rotate the outboard motor main body with respect to the hull, and when it is not necessary to rapidly rotate the outboard motor main body with respect to the hull, an increase in the driving energy to rotate the outboard motor main body in the right-left direction with respect to the hull is significantly reduced or prevented.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings.

The structure of a marine vessel 100 according to preferred embodiments of the present invention is now described with reference to FIGS. 1 to 7.

Figure 1:
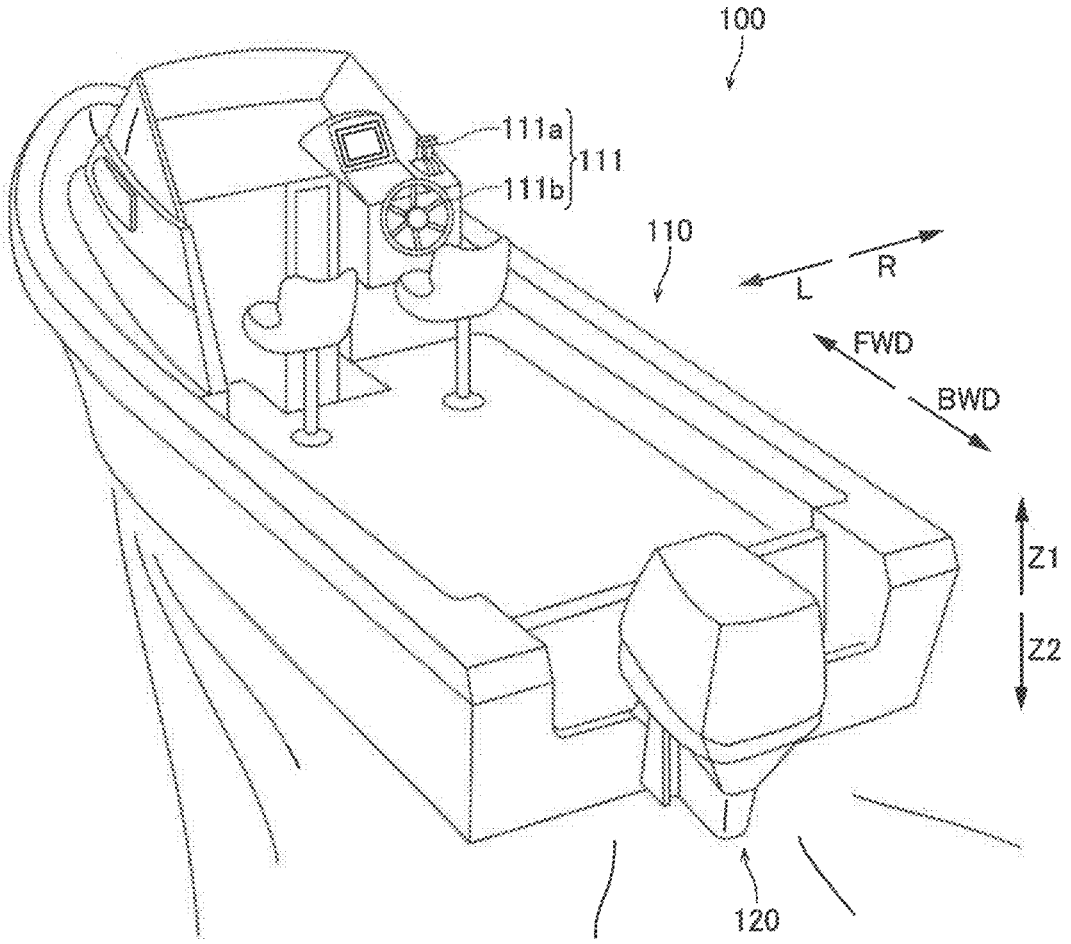
FIG. 1 is a perspective view showing a marine vessel according to a preferred embodiment of the present invention.

As shown in FIG. 1, the marine vessel 100 includes a hull 110 and an outboard motor 120. The outboard motor 120 is attached to a rear transom of the hull 110. One outboard motor 120 is attached to the hull 110. The outboard motor 120 is a marine propulsion device that propels the hull 110. The marine vessel 100 may be a relatively small marine vessel. The marine vessel 100 may be used for sightseeing in a canal and a lake, for example.

In the figures, arrow FWD and arrow BWD represent the front side and the rear side of the marine vessel 100, respectively. In the figures, arrow L and arrow R represent the left side and the right side of the marine vessel 100, respectively. In the figures, arrow Z1 and arrow Z2 represent the upper side and the lower side of the marine vessel 100, respectively. Each figure shows a state in which a drive shaft 14 (see FIG. 2) described below of the outboard motor 120 extends in an upward-downward direction.

The hull 110 includes an operator 111 to receive an operation to maneuver the marine vessel 100. The operator 111 includes a remote control 111*a* and a steering wheel 111*b*.

The remote control 111*a* includes a lever, and when the lever is operated, the propulsive force of the outboard motor 120 (the rotation speed of a propeller 12 (see FIG. 2)) is changed, and the shift state of the outboard motor 120 is switched.

The steering wheel 111*b* is rotatable, and the steering wheel 111*b* is rotated such that steering (changing the direction of the propeller 12 with respect to the hull 110) is performed.

Figure 2:
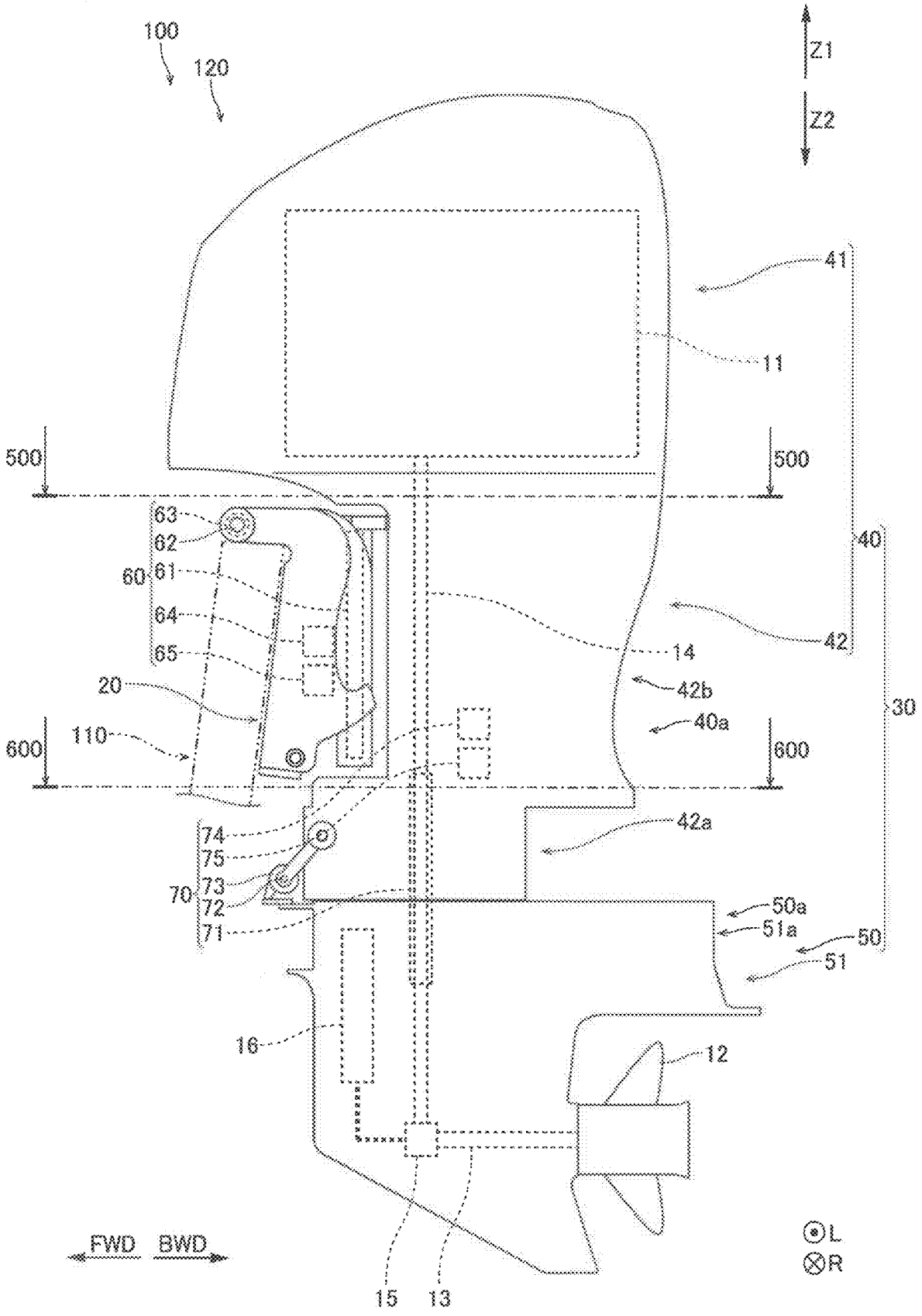
FIG. 2 is a side view showing an outboard motor according to a preferred embodiment of the present invention.

As shown in FIG. 2, the outboard motor 120 includes an engine 11, the propeller 12, a propeller shaft 13, the drive shaft 14, a gearing 15, and a shift actuator 16.

The engine 11 is an internal combustion engine that generates a driving force, for example. The engine 11 is provided as a drive source to drive the propeller 12. The drive shaft 14 transmits the driving force of the engine 11 to the propeller 12. Specifically, the driving force of the engine 11 is transmitted to the propeller 12 via the drive shaft 14 connected to a crankshaft (not shown) of the engine 11, the gearing 15 connected to the drive shaft 14, and the propeller shaft 13 connected to the gearing 15 and rotating together with the propeller 12. The propeller 12 generates a propulsive force by rotating in the water by the driving force transmitted from the engine 11.

The shift actuator 16 is configured to switch the shift state. Specifically, the shift actuator 16 is configured to switch between a forward state, a reverse state, and a neutral state by switching the meshing of the gear portion 15. The forward state is a state in which the driving force of the engine 11 is transmitted to the propeller 12 so as to generate a forward propulsive force in the propeller 12. The reverse state is a state in which the driving force of the engine 11 is transmitted to the propeller 12 so as to generate a backward propulsive force in the propeller 12. The neutral state is a state in which the driving force of the engine 11 is not transmitted to the propeller 12.

The shift actuator 16 switches the shift state. Specifically, the shift actuator 16 switches between a forward movement state, a backward movement state, and a neutral state by switching the meshing of the gearing 15. In the forward movement state, a driving force is transmitted from the engine 11 to the propeller 12 to generate a forward propulsive force in the propeller 12. In the backward movement state, a driving force is transmitted from the engine 11 to the propeller 12 to generate a backward propulsive force in the propeller 12. In the neutral state, a driving force is not transmitted from the engine 11 to the propeller 12.

The outboard motor 120 includes a bracket 20 and an outboard motor main body 30 attached to the hull 110 via the bracket 20. The outboard motor main body 30 includes an upper portion 40 and a lower portion 50 located below the upper portion 40.

The upper portion 40 includes a cowling 41 and an upper case 42 located below the cowling 41. The engine 11 is provided in the cowling 41. In the upper case 42, a portion on the Z1 side of the drive shaft 14 extending in the upward-downward direction across the upper portion 40 and the lower portion 50 is located. The upper portion 40 is attached to the rear transom of the hull 110 via the bracket 20. The bracket 20 includes a clamp bracket and a swivel bracket.

The lower portion 50 includes a lower case 51 in which the propeller shaft 13 is located. The propeller 12, the propeller shaft 13, a portion of the drive shaft 14 on the Z2 side, the gearing 15, and the shift actuator 16 are located in the lower case 51. The propeller shaft 13 extends in a forward-rearward direction in a portion of the lower case 51 on the Z2 side. The propeller 12 is connected to an end of the propeller shaft 13 on the BWD side. The propeller 12 is located outside the lower case 51.

In preferred embodiments of the present invention, the outboard motor 120 includes a first steering mechanism 60 to rotate the upper portion 40 in a right-left direction with respect to the hull 110, and a second steering mechanism 70 to rotate the lower portion 50 in the right-left direction with respect to the upper portion 50. That is, the outboard motor 120 includes the first steering mechanism 60 to rotate the entire outboard motor main body 30 including the upper portion 40 in the right-left direction with respect to the hull 110, and the second steering mechanism 70 to rotate the lower portion 50, which is a portion of the outboard motor main body 30, in the right-left direction with respect to the upper portion 40, which is another portion of the outboard motor main body 30. The outboard motor 120 includes only two steering mechanisms: the first steering mechanism 60 and the second steering mechanism 70.

Figure 3:
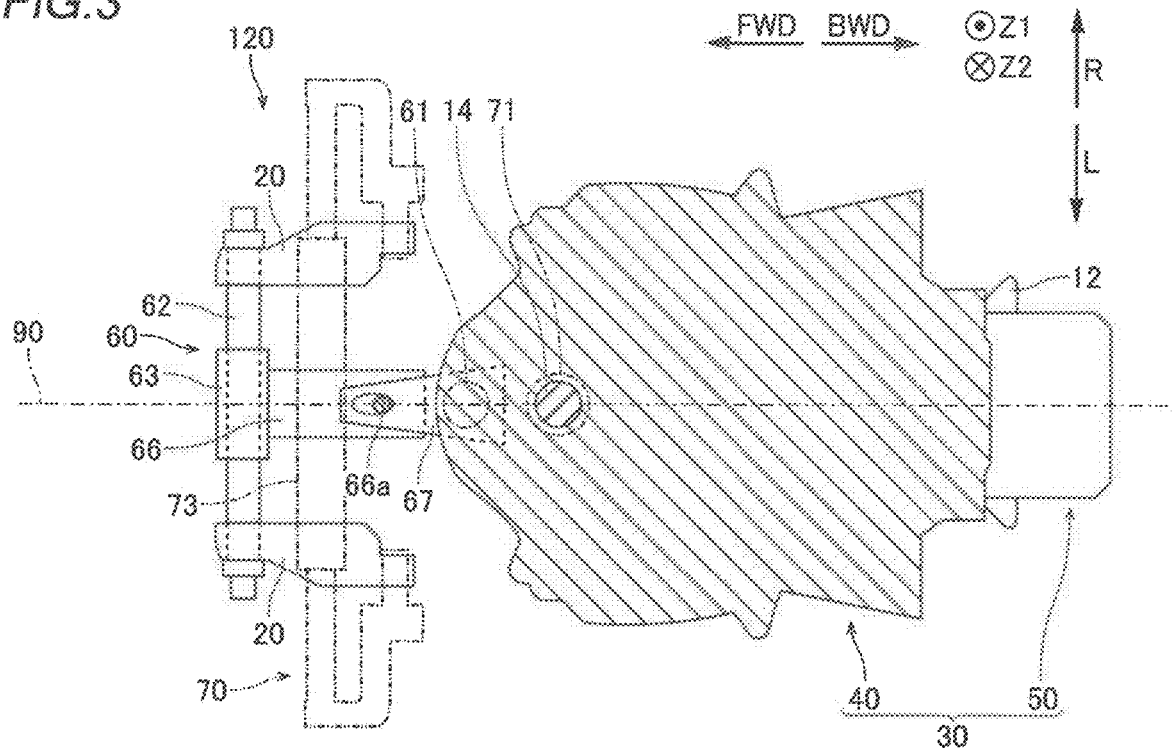
FIG. 3 is a sectional view taken along the line 500-500 in FIG. 2.
Figure 4:
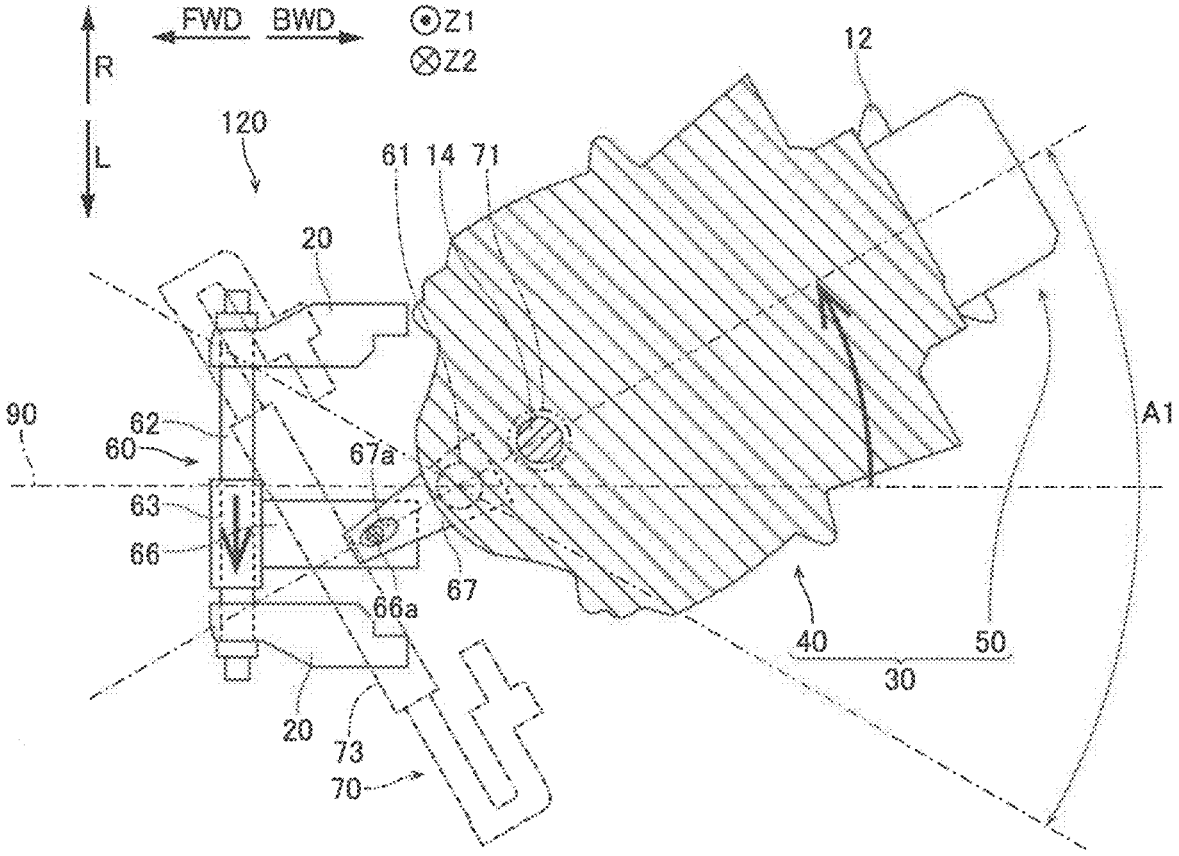
FIG. 4 is a diagram showing a state in which an upper portion is rotated with respect to a hull by a first steering mechanism from the state shown in FIG. 3.

As shown in FIGS. 3 and 4, in preferred embodiments of the present invention, the first steering mechanism 60 rotates the upper portion 40 around a first steering shaft 61 in the right-left direction with respect to the hull 110.

Specifically, as shown in FIG. 3, the first steering mechanism 60 includes a cylinder rod 62, a steering cylinder 63, a hydraulic pump 64 (see FIG. 2), a pump drive motor 65 (see FIG. 2), a connecting bracket 66, a steering bracket 67, and the first steering shaft 61.

The cylinder rod 62 is fixed to the bracket 20. The cylinder rod 62 extends in the right-left direction.

The cylinder rod 62 passes through the steering cylinder 63. Furthermore, two oil chambers are provided inside the steering cylinder 63 to store hydraulic oil. The steering cylinder 63 reduces the amount of hydraulic oil stored in one of the two oil chambers and increases the amount of hydraulic oil stored in the other of the two oil chambers to move in the right-left direction along the cylinder rod 62.

The hydraulic pump 64 rotates the first steering shaft 61. The pump drive motor 65 drives the hydraulic pump 64. When the hydraulic pump 64 is driven by the pump drive motor 65, hydraulic oil is supplied to one of the two oil chambers of the steering cylinder 63 and is discharged from the other of the two oil chambers of the steering cylinder 63 via an oil pipe (not shown).

The connecting bracket 66 is fixed to the steering cylinder 63, and moves in the right-left direction as the steering cylinder 63 moves in the right-left direction. A connecting pin 66*a* protrudes in the upward-downward direction on a portion of the connecting bracket 66 on the BWD side.

The steering bracket 67 includes an elongated hole 67*a* that engages with the connecting pin 66*a* of the connecting bracket 66. The steering bracket 67 is fixed to the upper case 42.

As shown in FIG. 2, the first steering shaft 61 extends in the upward-downward direction in an upper portion 42*b* of the upper case 42. The first steering shaft 61 is located in front of the drive shaft 14.

With the structure described above, as shown in FIG. 4, when the steering cylinder 63 moves in the right-left direction along the cylinder rod 62, the connecting bracket 66 also moves in the right-left direction. Then, the upper case 42 to which the steering bracket 67 including the elongated hole 67*a* that engages with the connecting pin 66*a* of the connecting bracket 66 is fixed rotates in the right-left direction around the first steering shaft 61. Thus, the lower portion 50 (on which the propeller 12 is provided) is rotated together with the upper portion 40 in the right-left direction around the first steering shaft 61 with respect to the hull 110. That is, steering (changing the direction of the propeller 12 with respect to the hull 110) is performed.

An angular range A1 in which the upper portion 40 is rotatable in the right-left direction with respect to the hull 110 by the first steering mechanism 60 is relatively small (60 degrees, for example) such that the rotated upper portion 40 does not interfere with the bracket 20. FIG. 4 shows a state in which the first steering mechanism 60 rotates the upper portion 40 with respect to the hull 110 by an angle (about 30 degrees, for example) corresponding to half of the angular range A1 to the R side from a centerline 90 of the hull 110 in the right-left direction that extends in the forward-rearward direction.

Figure 5:
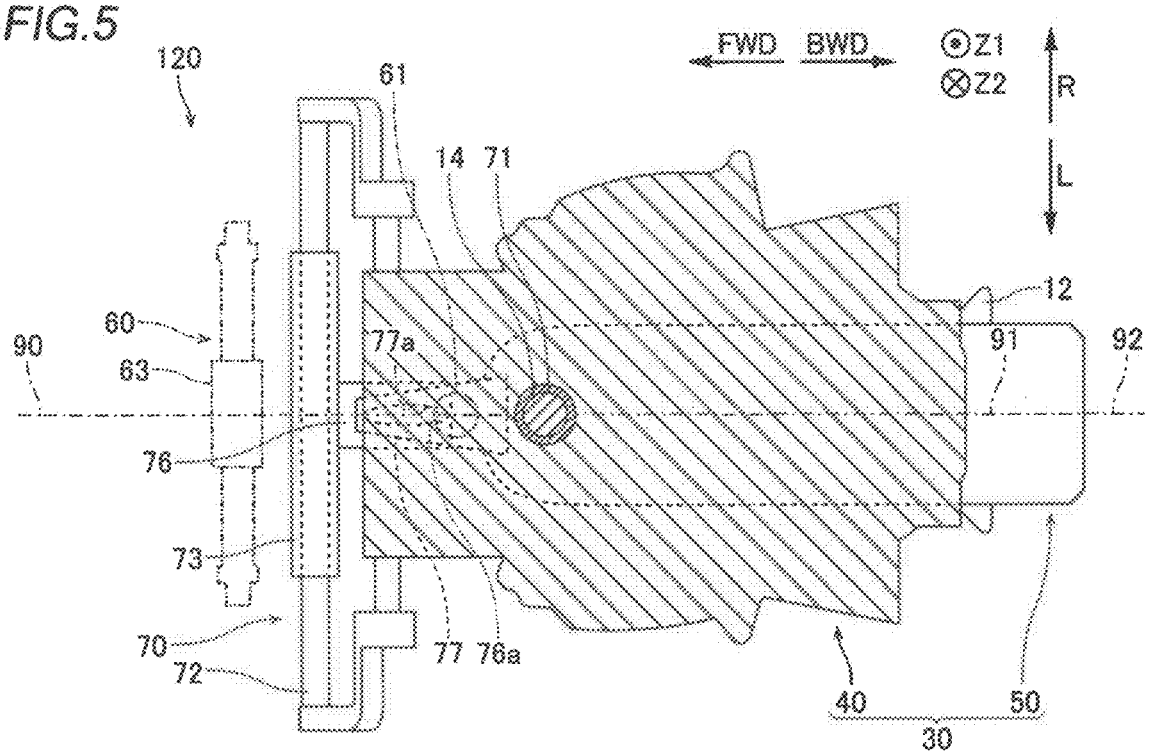
FIG. 5 is a sectional view taken along the line 600-600 in FIG. 2.
Figure 6:
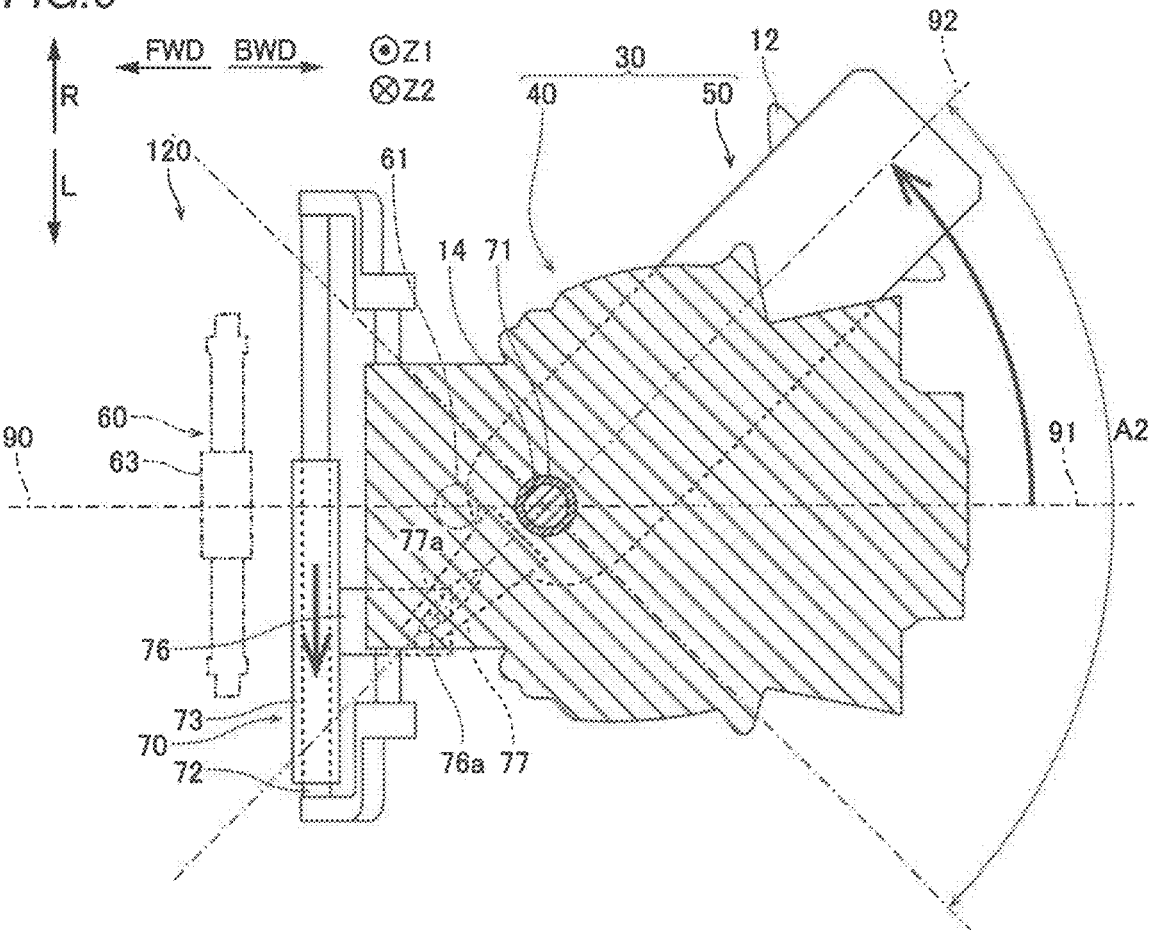
FIG. 6 is a diagram showing a state in which a lower portion is rotated with respect to an upper portion by a second steering mechanism from the state shown in FIG. 5.

As shown in FIGS. 5 and 6, in preferred embodiments of the present invention, the second steering mechanism 70 rotates the lower portion 50 with respect to the upper portion 40 in the right-left direction around a second steering shaft 71 provided separately from the first steering shaft 61. The second steering mechanism 70 is a hydraulic drive mechanism having the same or similar structure as the first steering mechanism 60.

Specifically, as shown in FIG. 5, the second steering mechanism 70 includes a cylinder rod 72, a steering cylinder 73, a hydraulic pump 74 (see FIG. 2), a pump drive motor 75 (see FIG. 2), a connecting bracket 76, a steering bracket 77, and the second steering shaft 71.

As shown in FIG. 2, the cylinder rod 72 is fixed to a lower portion 42*a* of the upper case 42. That is, in preferred embodiments of the present invention, the second steering mechanism 70 is partially fixed to the lower portion 42*a* of the upper case 42. As shown in FIG. 5, the cylinder rod 72 extends in the right-left direction.

The cylinder rod 72 passes through the steering cylinder 73. Furthermore, two oil chambers are provided inside the steering cylinder 73 to store hydraulic oil. The steering cylinder 73 reduces the amount of hydraulic oil stored in one of the two oil chambers and increases the amount of hydraulic oil stored in the other of the two oil chambers to move in the right-left direction along the cylinder rod 72.

The hydraulic pump 74 rotates the second steering shaft 71. The pump drive motor 75 drives the hydraulic pump 74. As shown in FIG. 2, in preferred embodiments of the present invention, the hydraulic pump 74 and the pump drive motor 75 are provided in a lower portion 40*a* of the upper portion 40. When the hydraulic pump 74 is driven by the pump drive motor 75, hydraulic oil is supplied to one of the two oil chambers of the steering cylinder 73 and is discharged from the other of the two oil chambers of the steering cylinder 73 via an oil pipe (not shown).

As shown in FIG. 5, the connecting bracket 76 is fixed to the steering cylinder 73, and moves in the right-left direction as the steering cylinder 73 moves in the right-left direction. A connecting pin 76*a* protrudes in the upward-downward direction on a portion of the connecting bracket 76 on the BWD side.

The steering bracket 77 includes an elongated hole 77*a* that engages with the connecting pin 76*a* of the connecting bracket 76. The steering bracket 77 is fixed to an upper portion 51*a* of the lower case 51. That is, as shown in FIG. 2, in preferred embodiments of the present invention, the second steering mechanism 70 is partially fixed to the upper portion 51*a* of the lower case 51.

The second steering shaft 71 extends in the upward-downward direction across the lower portion 42*a* of the upper case 42 and the upper portion 51*a* of the lower case 51. That is, in preferred embodiments of the present invention, the second steering shaft 71 extends in the upward-downward direction across the lower portion 40*a* of the upper portion 40 and an upper portion 50*a* of the lower portion 50.

In preferred embodiments of the present invention, the second steering shaft 71 is coaxial with the drive shaft 14. That is, the second steering shaft 71 is located behind the first steering shaft 61.

With the structure described above, as shown in FIG. 6, when the steering cylinder 73 moves in the right-left direction along the cylinder rod 72, the connecting bracket 76 also moves in the right-left direction. Then, the lower case 51 to which the steering bracket 77 including the elongated hole 77*a* that engages with the connecting pin 76*a* of the connecting bracket 76 is fixed rotates in the right-left direction around the second steering shaft 71. Thus, the lower portion 50 (on which the propeller 12 is provided) is rotated in the right-left direction around the second steering shaft 71 with respect to the upper portion 40 attached to the hull 110. That is, steering (changing the direction of the propeller 12 with respect to the hull 110) is performed. As described above, the shift actuator 16 is provided in the lower portion 50. That is, in preferred embodiments of the present invention, the shift actuator 16 is rotated together with the lower portion 50 by the second steering mechanism 70.

In preferred embodiments of the present invention, an angular range A2 in which the lower portion 50 is rotatable in the right-left direction with respect to the upper portion 40 by the second steering mechanism 70 is larger (about 90 degrees, for example) than the angular range A1 in which the upper portion 40 is rotatable in the right-left direction with respect to the hull 110 by the first steering mechanism 60. FIG. 6 shows a state in which the second steering mechanism 70 rotates the lower portion 50 with respect to the upper portion 40 by an angle (about 45 degrees, for example) corresponding to half the angular range A2 to the R side from the centerline 90 of the hull 110. In other words, FIG. 6 shows a state in which the second steering mechanism 70 rotates the lower portion 50 with respect to the upper portion 40 by the angle corresponding to half the angular range A2 to the R side from a state in which the centerline 90 of the hull 110, a centerline 91 of the upper portion 40 in the right-left direction, and a centerline 92 of the lower portion 50 in the right-left direction are aligned (a state in FIG. 5).

Figure 7:
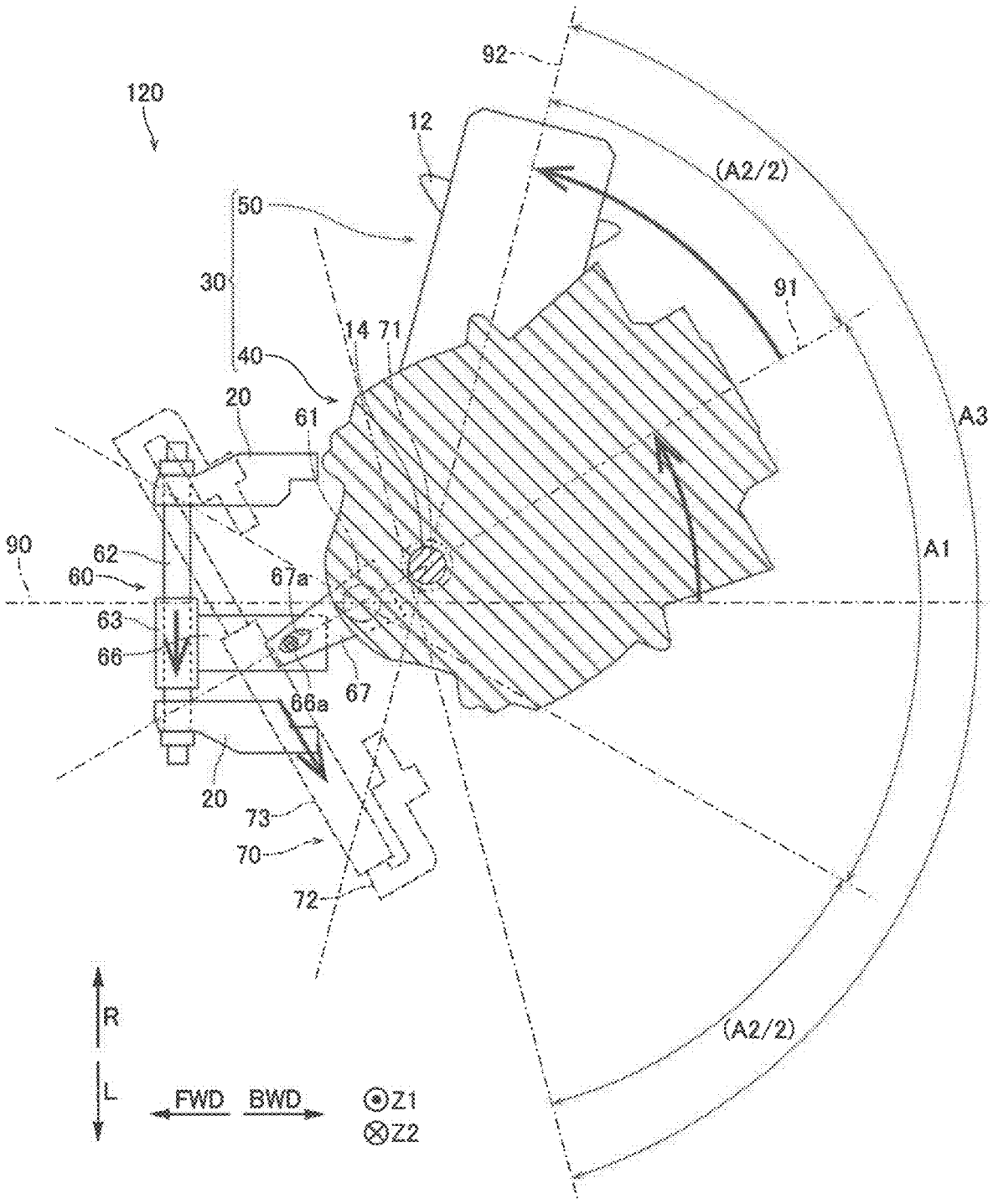
FIG. 7 is a diagram showing a state in which an upper portion is rotated with respect to a hull by a first steering mechanism and a lower portion is rotated with respect to the upper portion by a second steering mechanism from the state shown in FIG. 3.

In preferred embodiments of the present invention, the first steering mechanism 60 and the second steering mechanism 70 are operable independently of each other. Specifically, in the outboard motor 120, only the first steering mechanism 60 is able to be driven, as shown in FIGS. 3 and 4, and only the second steering mechanism 70 is able to be driven, as shown in FIGS. 5 and 6. Furthermore, as shown in FIG. 7, both the first steering mechanism 60 and the second steering mechanism 70 are able to be driven at the same time. Thus, an angular range A3 in which the outboard motor main body 30 is rotatable in the right-left direction with respect to the hull 110 is the sum of the angular range A1 in which the upper portion 40 is rotatable in the right-left direction with respect to the hull 110 by the first steering mechanism 60 and the angular range A2 in which the lower portion 50 is rotatable in the right-left direction with respect to the upper portion 40 by the second steering mechanism 70.

FIG. 7 shows a state in which the first steering mechanism 60 rotates the upper portion 40 with respect to the hull 110 by the angle (about 30 degrees, for example) corresponding to half the angular range A1 to the R side from the centerline 90 of the hull 110 and the second steering mechanism 70 rotates the lower portion 50 with respect to the upper portion 40 by the angle (about 45 degrees, for example) corresponding to half the angular range A2 to the R side from the centerline 91 of the upper portion 40 rotated by the angle corresponding to half the angular range A1 to the R side from the centerline 90 of the hull 110. That is, FIG. 7 shows a state in which the first steering mechanism 60 and the second steering mechanism 70 rotate the lower portion 50 (i.e., the propeller 12) with respect to the hull 110 by an angle (about 75 degrees, for example) corresponding to half the angular range A3 to the R side from the centerline 90 of the hull 110.

In preferred embodiments of the present invention, both the first steering mechanism 60 and the second steering mechanism 70 are driven when the steering angle is larger than a predetermined steering angle or when the steering speed is higher than a predetermined speed. That is, when the outboard motor main body 30 is largely rotated with respect to the hull 110 or when the outboard motor main body 30 is rapidly rotated with respect to the hull 110, both the first steering mechanism 60 and the second steering mechanism 70 are driven. When the steering angle is equal to or smaller than the predetermined steering angle or when the steering speed is equal to or lower than the predetermined speed, (only) the second steering mechanism 70 is driven. That is, when the outboard motor main body 30 is not largely rotated with respect to the hull 110 or when the outboard motor main body 30 is not rapidly rotated with respect to the hull 110, only the second steering mechanism 70 of the first steering mechanism 60 and the second steering mechanisms 70 is driven.

According to the various preferred embodiments of the present invention described above, the following advantageous effects are achieved.

According to a preferred embodiment of the present invention, the outboard motor 120 includes the first steering mechanism 60 to rotate the upper portion 40 in the right-left direction with respect to the hull 110, and the second steering mechanism 70 to rotate the lower portion 50 in the right-left direction with respect to the upper portion 40. Accordingly, the first steering mechanism 60 rotates the entire outboard motor main body 30 including the upper portion 40 attached to the hull 110 via the bracket 20 and the lower portion 50 located below the upper portion 40 in the right-left direction with respect to the hull 110, and the second steering mechanism 70 rotates the lower portion 50, which is a portion of the outboard motor main body 30, in the right-left direction with respect to the upper portion 40, which is another portion of the outboard motor main body 30. Consequently, the rotation of the entire outboard motor main body 30 in the right-left direction by the first steering mechanism 60 and the rotation of the partial outboard motor main body 30 in the right-left direction by the second steering mechanism 70 are combined such that the angular range A3 in which the outboard motor main body 30 is rotatable in the right-left direction with respect to the hull 110 is increased as compared with a case in which the entire outboard motor main body 30 is only rotated in the right-left direction. The lower portion 50 is rotated in the right-left direction with respect to the upper portion 40 by the second steering mechanism 70 without rotating the upper portion 40 attached to the hull 110 via the bracket 20 in the right-left direction, and thus the angular range A3 in which the outboard motor main body 30 is rotatable with respect to the hull 110 is increased while the outboard motor main body 30 does not interfere with the bracket 20.

According to a preferred embodiment of the present invention, the first steering mechanism 60 and the second steering mechanism 70 are operable independently of each other. Accordingly, the angular range A3 in which the outboard motor main body 30 is rotatable in the right-left direction with respect to the hull 110 is the sum of the angular range A1 in which the upper portion 40 is rotatable in the right-left direction with respect to the hull 110 by the first steering mechanism 60 and the angular range A2 in which the lower portion 50 is rotatable in the right-left direction with respect to the upper portion 40 by the second steering mechanism 70, and thus the angular range A3 in which the outboard motor main body 30 is rotatable with respect to the hull 110 is reliably increased.

According to a preferred embodiment of the present invention, the outboard motor 120 includes the engine 11 corresponding to a drive source to drive the propeller 12. Furthermore, the engine 11 is provided in the upper portion 40. Moreover, the angular range A2 in which the lower portion 50 is rotatable in the right-left direction with respect to the upper portion 40 by the second steering mechanism 70 is larger the angular range A1 in which the upper portion 40 is rotatable in the right-left direction with respect to the hull 110 by the first steering mechanism 60. The upper portion 40 in which the engine 11 is provided is particularly large in size, and thus particularly when the engine 11 is provided in the upper portion 40, the angular range A1 in which the upper portion 40 is rotatable in the right-left direction with respect to the hull 110 by the first steering mechanism 60 is limited to a small range such that the upper portion 40 does not interfere with the bracket 20 when the upper portion 40 is rotated with respect to the hull 110. On the other hand, as described above, the lower portion 50 is rotated in the right-left direction with respect to the upper portion 40 by the second steering mechanism 70 without rotating the upper portion 40 attached to the hull 110 via the bracket 20 in the right-left direction, and thus the angular range A3 in which the outboard motor main body 30 is rotatable with respect to the hull 110 is increased while the outboard motor main body 30 does not interfere with the bracket 20. Therefore, the angular range A3 in which the outboard motor main body 30 is rotatable in the right-left direction with respect to the hull 110 is effectively increased.

According to a preferred embodiment of the present invention, the first steering mechanism 60 rotates the upper portion 40 around the first steering shaft 61 in the right-left direction with respect to the hull 110. Furthermore, the second steering mechanism 70 rotates the lower portion 50 in the right-left direction with respect to the upper portion 40 around the second steering shaft 71 provided separately from the first steering shaft 61. Accordingly, the second steering shaft 71 is provided separately from the first steering shaft 61 such that the degree of freedom in providing the second steering shaft 71 with respect to the first steering shaft 61 is improved, and as compared with a case in which the second steering shaft 71 is not provided separately from the first steering shaft 61, complex structures of the first steering mechanism 60 and the second steering mechanism 70 are significantly reduced or prevented.

According to a preferred embodiment of the present invention, the second steering mechanism 70 includes the second steering shaft 71, the hydraulic pump 74 to rotate the second steering shaft 71, and the pump drive motor 75 to drive the hydraulic pump 74. Furthermore, the hydraulic pump 74 and the pump drive motor 75 are provided in the lower portion 40*a* of the upper portion 40. Moreover, the second steering shaft 71 extends across the lower portion 40*a* of the upper portion 40 and the upper portion 50*a* of the lower portion 50. Accordingly, the second steering shaft 71 extends across the lower portion 40*a* of the upper portion 40 and the upper portion 50*a* of the lower portion 50 such that as compared with a case in which the second steering shaft 71 does not extend across the upper portion 40 and the lower portion 50, the operation of the second steering mechanism 70 to rotate the lower portion 50 in the right-left direction around the second steering shaft 71 with respect to the upper portion 40 is stabilized. Furthermore, the hydraulic pump 74 and the pump drive motor 75 provided to rotate the second steering shaft 71 are provided in the lower portion 40*a* of the upper portion 40 that is relatively close to the second steering shaft 71 extending across the lower portion 40*a* of the upper portion 40 and the upper portion 50*a* of the lower portion 50, and thus an increase in a space to install the second steering mechanism 70 including the second steering shaft 71, the hydraulic pump 74, and the pump drive motor 75 is significantly reduced or prevented.

According to a preferred embodiment of the present invention, the second steering shaft 71 is located behind the first steering shaft 61. Accordingly, the lower portion 50 is less likely to be larger on the FWD side (hull 110 side) as compared with a case in which the second steering shaft 71 is located in front of the first steering shaft 61, and thus the angular range A3 in which the outboard motor main body 30 is rotatable with respect to the hull 110 is easily increased while the outboard motor main body 30 does not interfere with the bracket 20.

According to a preferred embodiment of the present invention, the outboard motor 120 includes the engine 11 corresponding to a drive source to drive the propeller 12, and the drive shaft 14 to transmit a driving force from the engine 11 to the propeller 12. Furthermore, the second steering shaft 71 is coaxial with the drive shaft 14. Accordingly, the second steering shaft 71 is coaxial with the drive shaft 14 such that as compared with a case in which the second steering shaft 71 is not coaxial with the drive shaft 14, an increase in a space to install the second steering shaft 71 and the drive shaft 14 is significantly reduced or prevented. Furthermore, the second steering shaft 71 is coaxial with the drive shaft 14 such that the lower portion 50 is rotated with respect to the upper portion 40 by the second steering mechanism 70 without changing the horizontal position of the drive shaft 14, and thus as compared with a case in which the second steering shaft 71 is not coaxial with the drive shaft 14, a complex structure of the second steering mechanism 70 is significantly reduced or prevented.

According to a preferred embodiment of the present invention, the outboard motor 120 includes the shift actuator 16 to switch the shift state. Furthermore, the shift actuator 16 is provided in the lower portion 50, and is rotated together with the lower portion 50 by the second steering mechanism 70. Accordingly, the shift actuator 16 is provided in the lower portion 50 and is rotated together with the lower portion 50 by the second steering mechanism 70 such that the lower portion 50 is rotated in the right-left direction with respect to the upper portion 40 by the second steering mechanism 70 while a complex structure of the shift actuator 16 is significantly reduced or prevented as compared with a case in which the shift actuator 16 is provided across the upper portion 40 and the lower portion 50, for example.

According to a preferred embodiment of the present invention, the outboard motor 120 includes the engine 11 corresponding to a drive source to drive the propeller 12, and the propeller shaft 13 that rotates together with the propeller 12. Furthermore, the upper portion 40 includes the cowling 41 in which the engine 11 is provided and the upper case 42 located below the cowling 41, and the lower portion 50 includes the lower case 51 in which the propeller shaft 13 is provided. Moreover, a portion of the second steering mechanism 70 is fixed to the lower portion 42*a* of the upper case 42, and another portion of the second steering mechanism 70 is fixed to the upper portion 51*a* of the lower case 51. Accordingly, a portion of the second steering mechanism 70 is fixed to the lower portion 42*a* of the upper case 42, and another portion of the second steering mechanism 70 is fixed to the upper portion 51*a* of the lower case 51 such that the second steering mechanism 70 easily rotates the lower portion 50 in the right-left direction with respect to the upper portion 40.

According to a preferred embodiment of the present invention, both the first steering mechanism 60 and the second steering mechanism 70 are driven when the steering angle is larger than the predetermined steering angle or when the steering speed is higher than the predetermined speed, and (only) the second steering mechanism 70 is driven when the steering angle is equal to or smaller than the predetermined steering angle or when the steering speed is equal to or lower than the predetermined speed. Accordingly, when it is necessary to largely rotate the outboard motor main body 30 with respect to the hull 110, both the first steering mechanism 60 and the second steering mechanism 70 are driven such that the outboard motor main body 30 is largely rotated with respect to the hull 110, and when it is necessary to rapidly rotate the outboard motor main body 30 with respect to the hull 110, both the first steering mechanism 60 and the second steering mechanism 70 are driven such that the outboard motor main body 30 is rapidly rotated with respect to the hull 110. When it is not necessary to largely rotate the outboard motor main body 30 with respect to the hull 110, and when it is not necessary to rapidly rotate the outboard motor main body 30 with respect to the hull 110, the second steering mechanism 70 is driven without driving the first steering mechanism 60 such that a portion of the outboard motor main body 30 is rotated with respect to another portion of the outboard motor main body 30 without rotating the entire outboard motor main body 30 with respect to the hull 110. Consequently, an increase in the driving energy to rotate the outboard motor main body 30 in the right-left direction with respect to the hull 110 is significantly reduced or prevented when it is not necessary to largely rotate the outboard motor main body 30 with respect to the hull 110, and when it is not necessary to rapidly rotate the outboard motor main body 30 with respect to the hull 110.

The preferred embodiments of the present invention described above are illustrative in all points and not restrictive. The extent of the present invention is not defined by the above description of the preferred embodiments but by the scope of the claims, and all modifications within the meaning and range equivalent to the scope of the claims are further included.

For example, while both the first steering mechanism 60 and the second steering mechanism 70 are preferably driven when the steering angle is larger than the predetermined steering angle or when the steering speed is higher than the predetermined speed, and (only) the second steering mechanism 70 is preferably driven when the steering angle is equal to or smaller than the predetermined steering angle or when the steering speed is equal to or lower than the predetermined speed in preferred embodiments described above, the present invention is not restricted to this. In a preferred embodiment of the present invention, the first steering mechanism may alternatively be driven, or the second steering mechanism may alternatively be driven regardless of the steering angle or the steering speed.

While a portion of the second steering mechanism 70 is preferably fixed to the lower portion 42*a* of the upper case 42, and another portion of the second steering mechanism 70 is preferably fixed to the upper portion 51*a* of the lower case 51 in preferred embodiments described above, the present invention is not restricted to this. In a preferred embodiment of the present invention, a portion of the second steering mechanism may alternatively be fixed to the upper portion of the upper case, or another portion of the second steering mechanism may alternatively be fixed to the lower portion of the lower case.

While the shift actuator 16 is preferably provided in the lower portion 50 and is preferably rotated together with the lower portion 50 by the second steering mechanism 70 in preferred embodiments described above, the present invention is not restricted to this. In a preferred embodiment of the present invention, the shift actuator may alternatively be provided in the upper portion and may not be rotated together with the lower portion by the second steering mechanism.

While the second steering shaft 71 is preferably coaxial with the drive shaft 14 in preferred embodiments described above, the present invention is not restricted to this. In a preferred embodiment of the present invention, the second steering shaft may not be coaxial with the drive shaft.

While the second steering shaft 71 is preferably located behind the first steering shaft 61 in preferred embodiments described above, the present invention is not restricted to this. In a preferred embodiment of the present invention, the second steering shaft may alternatively be located at the same position as the first steering shaft in the forward-rearward direction or may alternatively be located in front of the first steering shaft.

While the hydraulic pump 74 and the pump drive motor 75 are preferably provided in the lower portion 40*a* of the upper portion 40, and the second steering shaft 71 preferably extends across the lower portion 40*a* of the upper portion 40 and the upper portion 50*a* of the lower portion 50 in preferred embodiments described above, the present invention is not restricted to this. In a preferred embodiment of the present invention, the hydraulic pump and the pump drive motor may alternatively be provided in a portion (an upper portion of the upper portion, for example) other than the lower portion of the upper portion. Furthermore, the second steering shaft may alternatively extend across the upper portion of the upper portion and the upper portion of the lower portion, may alternatively extend across the lower portion of the upper portion and a lower portion of the lower portion, or may alternatively extend across the upper portion of the upper portion and the lower portion of the lower portion.

While the second steering mechanism 70 preferably includes the hydraulic pump 74 to rotate the second steering shaft 71, and the pump drive motor 75 to drive the hydraulic pump 74 in preferred embodiments described above, the present invention is not restricted to this. In a preferred embodiment of the present invention, the second steering mechanism may not include the hydraulic pump to rotate the second steering shaft or the pump drive motor to drive the hydraulic pump. In such a case, the second steering shaft may be rotated by electromotive drive instead of hydraulic drive, for example.

While the angular range A2 in which the lower portion 50 is rotatable in the right-left direction with respect to the upper portion 40 by the second steering mechanism 70 is preferably larger than the angular range A1 in which the upper portion 40 is rotatable in the right-left direction with respect to the hull 110 by the first steering mechanism 60 in preferred embodiments described above, the present invention is not restricted to this. In a preferred embodiment of the present invention, the angular range in which the lower portion is rotatable in the right-left direction with respect to the upper portion by the second steering mechanism may alternatively be equal to or smaller than the angular range in which the upper portion is rotatable in the right-left direction with respect to the hull by the first steering mechanism.

While the first steering mechanism 60 and the second steering mechanism 70 are preferably operable independently of each other in preferred embodiments described above, the present invention is not restricted to this. In a preferred embodiment of the present invention, the first steering mechanism and the second steering mechanism may alternatively operate in conjunction with each other.

Figure 8:
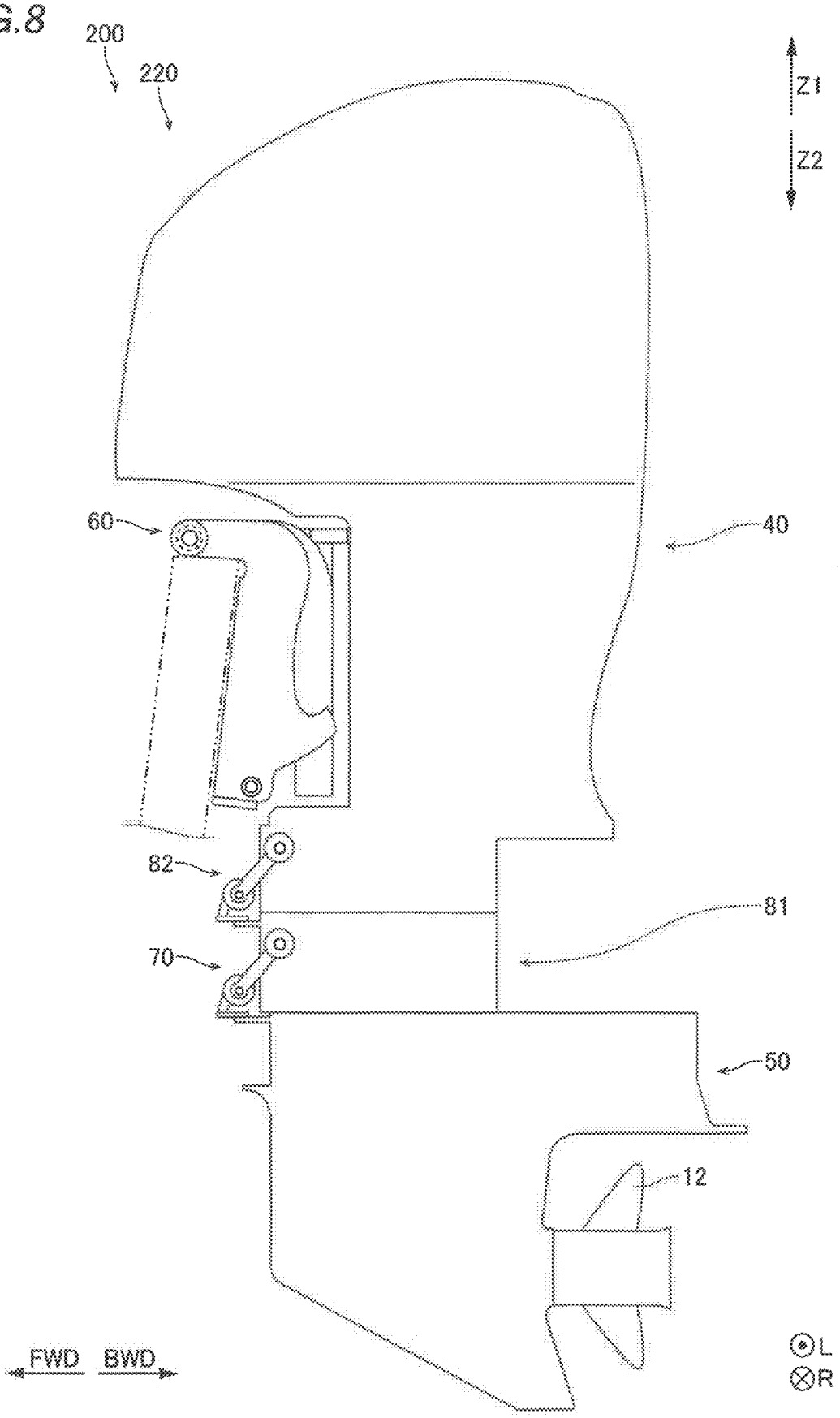
FIG. 8 is a side view showing an outboard motor according to a modified example of a preferred embodiment of the present invention.

While the outboard motor 120 preferably includes only two steering mechanisms, which are the first steering mechanism 60 and the second steering mechanism 70, in preferred embodiments described above, the present invention is not restricted to this. In a preferred embodiment of the present invention, the outboard motor may alternatively include three or more steering mechanisms. For example, when an outboard motor 220 includes three steering mechanisms as in a marine vessel 200 shown in FIG. 8, the outboard motor 220 may include a middle portion 81 below an upper portion 40 and above a lower portion 50, and may include a third steering mechanism 82 to rotate the lower portion 50 in a right-left direction with respect to the middle portion 81 in addition to a first steering mechanism 60 that rotate the upper portion 40 in the right-left direction with respect to a hull 110 and a second steering mechanism 70 that rotates the lower portion 50 in the right-left direction (via the middle portion 81) with respect to the upper portion 40.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

a bracket;

an outboard motor main body including an upper portion attachable to a hull via the bracket and a lower portion located below the upper portion and on which a propeller is provided;

a first steering mechanism to rotate the upper portion in a right-left direction with respect to the hull; and a second steering mechanism to rotate the lower portion in the right-left direction with respect to the upper portion; wherein the lower portion has an angular range in which the lower portion is rotatable in the right-left direction with respect to the upper portion by the second steering mechanism;

the upper portion has an angular range in which the upper portion is rotatable in the right-left direction with respect to the hull by the first steering mechanism; and the angular range of the lower portion is larger than the angular range of the upper portion.

2. The outboard motor according to claim 1, wherein the first steering mechanism and the second steering mechanism are operable independently of each other.

3. The outboard motor according to claim 1, further comprising:

an engine to drive the propeller; wherein the engine is provided in the upper portion.

4. The outboard motor according to claim 1, wherein the first steering mechanism includes a first steering shaft, and rotates the upper portion around the first steering shaft in the right-left direction with respect to the hull; and the second steering mechanism includes a second steering shaft provided separately from the first steering shaft, and rotates the lower portion around the second steering shaft in the right-left direction with respect to the upper portion.

5. The outboard motor according to claim 4, wherein the second steering mechanism further includes a hydraulic pump to rotate the second steering shaft, and a pump drive motor to drive the hydraulic pump;

the hydraulic pump and the pump drive motor are provided in a lower portion of the upper portion; and the second steering shaft extends across the lower portion of the upper portion and an upper portion of the lower portion.

6. The outboard motor according to claim 4, wherein the second steering shaft is located behind the first steering shaft.

7. The outboard motor according to claim 4, further comprising:

an engine to drive the propeller; and a drive shaft to transmit a driving force from the engine to the propeller; wherein the second steering shaft is coaxial with the drive shaft.

8. The outboard motor according to claim 1, further comprising:

a shift actuator to switch a shift state of the outboard motor; wherein the shift actuator is provided in the lower portion; and the second steering mechanism rotates the shift actuator together with the lower portion.

9. The outboard motor according to claim 1, further comprising:

an engine to drive the propeller; and a propeller shaft rotatable together with the propeller; wherein the upper portion includes a cowling in which the engine is provided, and an upper case below the cowling;

the lower portion includes a lower case in which the propeller shaft is provided; and the second steering mechanism includes a portion fixed to a lower portion of the upper case, and another portion fixed to an upper portion of the lower case.

10. An outboard motor comprising:

a bracket;

an outboard motor main body including an upper portion attachable to a hull via the bracket and a lower portion located below the upper portion and on which a propeller is provided;

a first steering mechanism to rotate the upper portion in a right-left direction with respect to the hull; and a second steering mechanism to rotate the lower portion in the right-left direction with respect to the upper portion; The outboard motor according to claim 1, wherein both the first steering mechanism and the second steering mechanism are driven when a steering angle of the outboard motor is larger than a predetermined steering angle or when a steering speed of the outboard motor is higher than a predetermined speed; and only the second steering mechanism is driven when the steering angle is equal to or smaller than the predetermined steering angle or when the steering speed is equal to or lower than the predetermined speed.

11. A marine vessel comprising:

a hull; and an outboard motor attached to the hull; wherein the outboard motor includes:

a bracket;

an outboard motor main body including an upper portion attached to the hull via the bracket and a lower portion located below the upper portion and on which a propeller is provided;

a first steering mechanism to rotate the upper portion in a right-left direction with respect to the hull; and a second steering mechanism to rotate the lower portion in the right-left direction with respect to the upper portion; wherein the lower portion has an angular range in which the lower portion is rotatable in the right-left direction with respect to the upper portion by the second steering mechanism;

the upper portion has an angular range in which the upper portion is rotatable in the right-left direction with respect to the hull by the first steering mechanism; and the angular range of the lower portion is larger than the angular range of the upper portion.

12. The marine vessel according to claim 11, wherein the first steering mechanism and the second steering mechanism are operable independently of each other.

13. The marine vessel according to claim 11, wherein the outboard motor further includes an engine to drive the propeller; and the engine is provided in the upper portion.

14. The marine vessel according to claim 11, wherein the first steering mechanism includes a first steering shaft, and rotates the upper portion around the first steering shaft in the right-left direction with respect to the hull; and the second steering mechanism includes a second steering shaft provided separately from the first steering shaft, and rotates the lower portion around the second steering shaft in the right-left direction with respect to the upper portion.

15. The marine vessel according to claim 14, wherein the second steering mechanism further includes a hydraulic pump to rotate the second steering shaft, and a pump drive motor to drive the hydraulic pump;

the hydraulic pump and the pump drive motor are provided in a lower portion of the upper portion; and the second steering shaft extends across the lower portion of the upper portion and an upper portion of the lower portion.

16. The marine vessel according to claim 14, wherein the second steering shaft is located behind the first steering shaft.

17. The marine vessel according to claim 14, wherein the outboard motor further includes:

an engine to drive the propeller; and a drive shaft to transmit a driving force from the engine to the propeller; and the second steering shaft is coaxial with the drive shaft.

18. The marine vessel according to claim 11, wherein the outboard motor further includes a shift actuator to switch a shift state of the outboard motor;

the shift actuator is provided in the lower portion; and the second steering mechanism rotates the shift actuator together with the lower portion.

19. The marine vessel according to claim 11, wherein the outboard motor further includes:

an engine to drive the propeller; and a propeller shaft rotatable together with the propeller;

the upper portion includes a cowling in which the engine is provided, and an upper case below the cowling;

the lower portion includes a lower case in which the propeller shaft is provided; and the second steering mechanism includes a portion fixed to a lower portion of the upper case, and another portion fixed to an upper portion of the lower case.

20. A marine vessel comprising:

a hull; and an outboard motor attached to the hull; wherein the outboard motor includes:

a bracket;

an outboard motor main body including an upper portion attached to the hull via the bracket and a lower portion located below the upper portion and on which a propeller is provided;

a first steering mechanism to rotate the upper portion in a right-left direction with respect to the hull; and a second steering mechanism to rotate the lower portion in the right-left direction with respect to the upper portion; wherein both the first steering mechanism and the second steering mechanism are driven when a steering angle of the outboard motor is larger than a predetermined steering angle or when a steering speed of the outboard motor is higher than a predetermined speed; and only the second steering mechanism is driven when the steering angle is equal to or smaller than the predetermined steering angle or when the steering speed is equal to or lower than the predetermined speed.

* * * * *